United States Patent [19]

Pon

[11] Patent Number: 4,763,089

[45] Date of Patent: Aug. 9, 1988

[54] MICROWAVE MULTIBAND FILTER

[75] Inventor: Chuck Y. Pon, Belmont, Calif.

[73] Assignee: Dalmo Victor, Inc., Belmont, Calif.

[21] Appl. No.: 105,899

[22] Filed: Oct. 8, 1987

[51] Int. Cl.[4] ..... H01P 1/213; H01P 1/203

[52] U.S. Cl. ..... 333/202; 333/103; 333/134; 333/205

[58] Field of Search ..... 333/202-208, 333/1, 103-105, 110, 174, 177, 219, 221, 235, 246, 262, 263, 109, 126-128, 132, 134-136, 101, 175, 245, 106-108

[56] References Cited

U.S. PATENT DOCUMENTS

| | | | |
|---|---|---|---|
| 3,503,014 | 3/1970 | Hall et al. | 333/207 X |
| 4,349,799 | 9/1982 | Blocksome et al. | 333/105 X |
| 4,584,543 | 4/1986 | Taylor, Jr. et al. | 333/103 |

FOREIGN PATENT DOCUMENTS

| | | | |
|---|---|---|---|
| 0051312 | 3/1985 | Japan | 333/103 |

*Primary Examiner*—Marvin L. Nussbaum
*Attorney, Agent, or Firm*—Flehr, Hohbach, Test, Albritton & Herbert

[57] ABSTRACT

A multiband microwave filter that can selectively transmit a broadband signal or any discret or combination of predefined frequency bands. The filter has two transmission lines, with an output port at one end of a first one of the transmission lines. A switch selectively transmits an input signal to one of the transmission lines. The filter also has a plurality of narrowband directional filters, each of which is used to transmit signals in a corresonding frequency band from one of the transmission lines to the other. Each directional filter includes at least one diode for enabling and disabling the operation of the direction filter in accordance with a bias voltage applied to the diodes. By controlling the switch and applying appropriate bias voltages to each of the diodes, the microwave filter can selectively transmit a broadband signal or any discret or combination of the frequency bands transmitted by the directional filters.

4 Claims, 7 Drawing Sheets

SERIES DIODES

SHUNT DIODES $$C_{01} = 1/(Q_e/2\pi + 1/2)^{1/2}$$

$$C_{12} = \pi\omega/(g_1 g_2)^{1/2}$$

$$(Z_{0_e})_{01} = Z_0((1+C_{01})/(1-C_{01}))^{1/2}$$

$$(Z_{0_o})_{01} = Z_0((1-C_{01})/(1+C_{01}))^{1/2}$$

$$(Z_{0_e})_{12} = Z_0((1+C_{12})/(1-C_{12}))^{1/2}$$

$$(Z_{0_o})_{12} = Z_0((1-C_{12})/(1+C_{12}))^{1/2}$$

Where:

$\omega = (f_2 - f_1)/f_0$ $f_0$ = center frequency of channel = $1/l_0$ $f_1$ = lower edge of channnel $f_2$ = upper edge of channel $g_1$, $g_2$ are lowpass prototype normalized element values $Q_e = g_1/\omega$ = external Q

*THREE RESONATOR DIRECTIONAL FILTER*

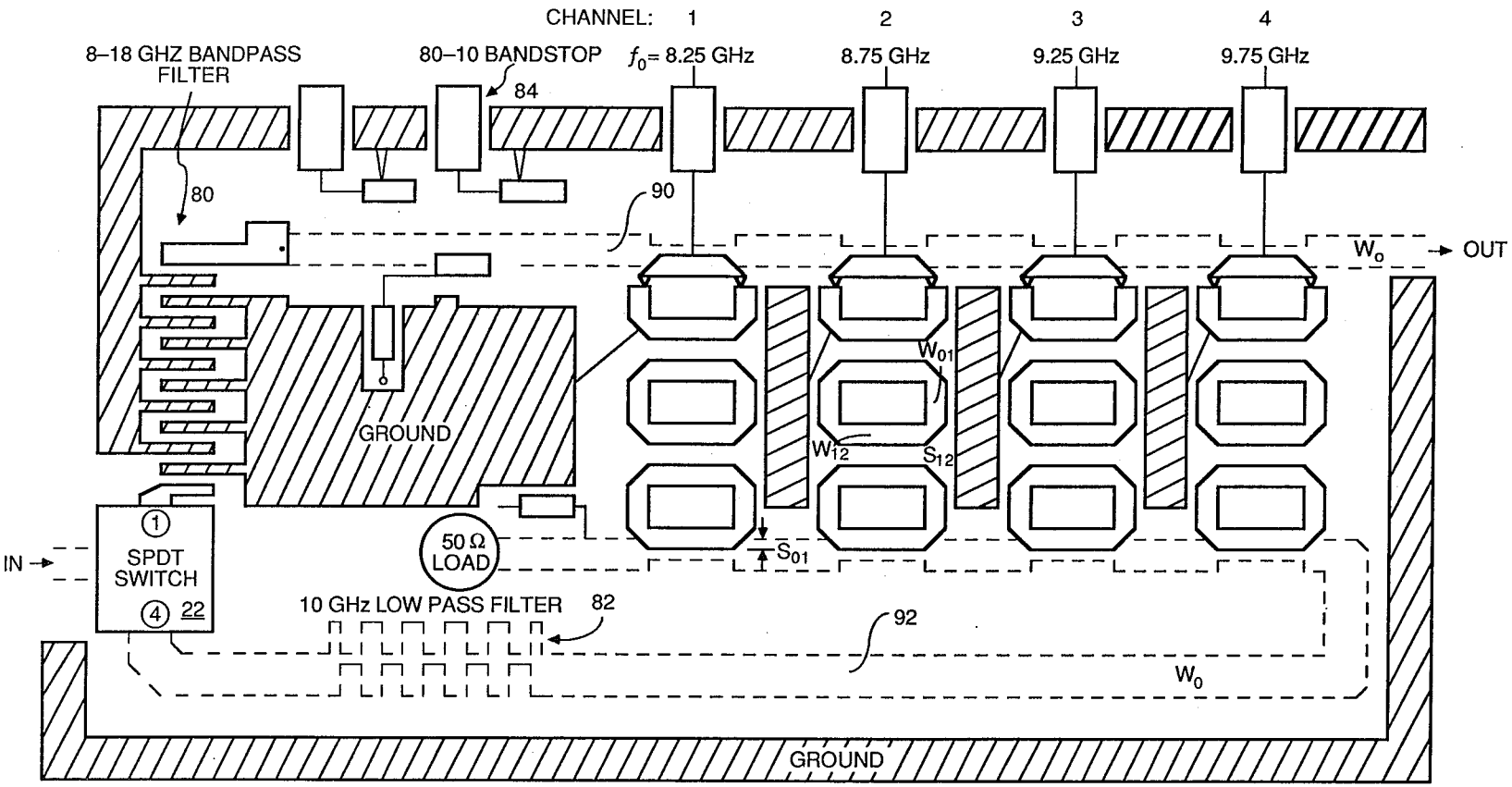
FIGURE 5 FOUR CHANNEL FILTER

FIGURE 8 EIGHT CHANNEL FILTER

MICROWAVE MULTIBAND FILTER

The present invention relates generally to microwave circuitry, and particularly to microwave bandpass filters.

BACKGROUND OF THE INVENTION

The prior art includes directional microwave filter circuits, but does not include multiband microwave filters which can selectively transmit any discrete or combination of narrowband signals without resorting to the use of single pole multi-throw switches.

In a growing number of applications, it is necessary to be able to separate and identify many narrowband signals in a high density signal environment. Given the high processing speeds of currently available signal processors, microcomputers and minicomputers, such applications need multiband microwave filters which can switch frequency bands easily and quickly.

An obvious, but inadequate, design of a multiband microwave filter is one which connects a set of bandpass filters with two single pole multithrow switches. However, the maximum number of output ports for a multithrow switch is typically less than eight due to physical constraints, and the insertion loss of each switch is about 3 dB (decibels) at X-band frequencies. Consequently, any system with more than eight channels will require more than two multithrow switches—which will increase the signal loss accordingly.

It is therefore a primary object of the present invention to provide an multiband microwave filter which can selectively transmit any combination of a large number of frequency bands without resorting to the use of single pole multithrow switches.

Another object of the present invention is to provide a multiband microwave directional filter which can also be used as an allpass circuit.

SUMMARY OF THE INVENTION

In summary, the present invention is a multiple band microwave filter having a plurality of narrow band directional filters between two transmission lines. Each of the directional filters can be enabled or disabled by a corresponding control signal. Also, a switch directs an incoming signal to one of the two transmission lines. If the incoming signal is coupled to a first one of the transmission lines, while all of the directional filters are off, the circuit acts as an allpass circuit. If the incoming signal is coupled to the other transmission line, only the frequency bands corresponding to the directional filters which are enabled are transmitted to an output port on the first transmission line. Thus, by controlling the switch and by selectively enabling the directional filters, the circuit can be used to transmit selectively a broadband signal or any discrete or combination of narrow band signals.

BRIEF DESCRIPTION OF THE DRAWINGS

Additional objects and features of the invention will be more readily apparent from the following detailed description and appended claims when taken in conjunction with the drawings, in which:

FIGS. *2a* and *2b* depict two microwave directional filters which can be used in the present invention.

Figure 3:
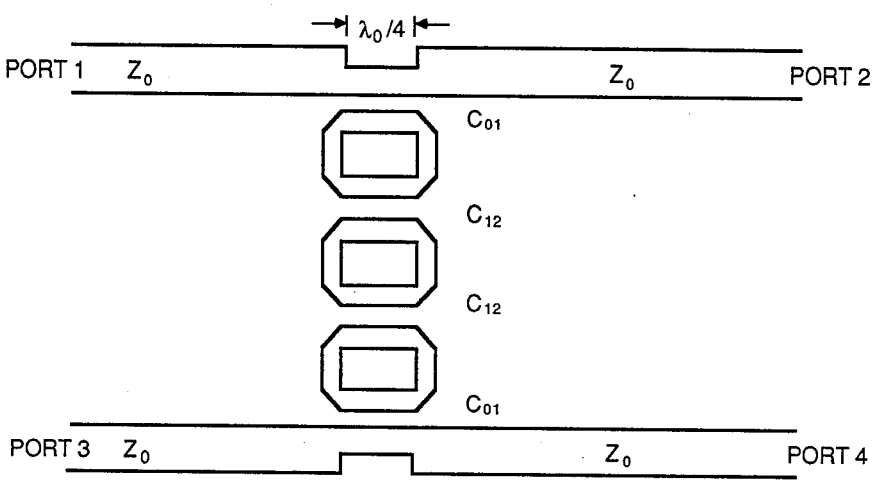

FIG. 3 is a schematic representation of a single three resonator directional filter.

FIG. *4a* depicts a single switchable resonator, and FIG. *4b* shows transmission response measurements made using this resonator.

FIG. 5 is depicts a four channel, 8 to 18 GHz switchable filter bank prototype.

Figure 6:
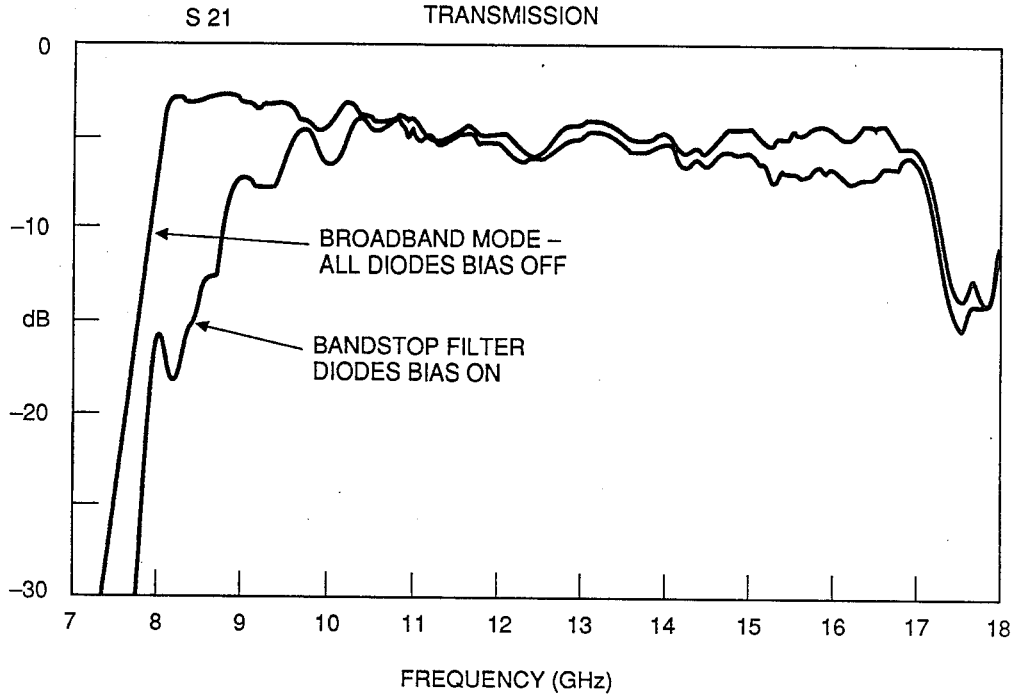
Figure 7:
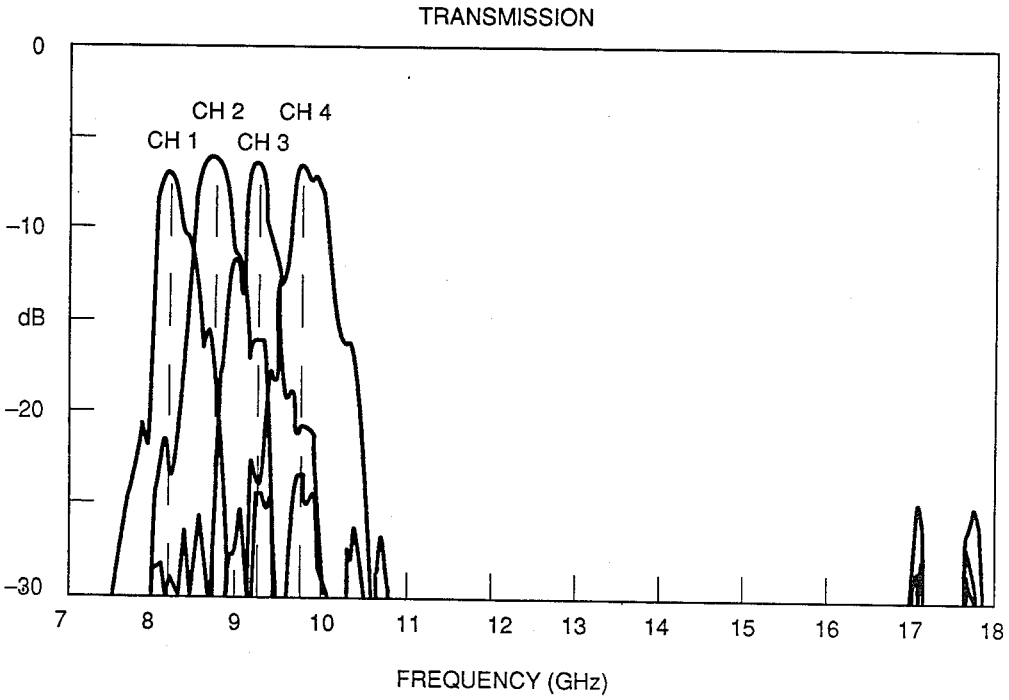

FIG. 6 shows the transmission frequency response of the filter in FIG. 5, in broadband mode, and FIG. 7 shows the transmission response for each channel with the other three channels off.

Figure 8:
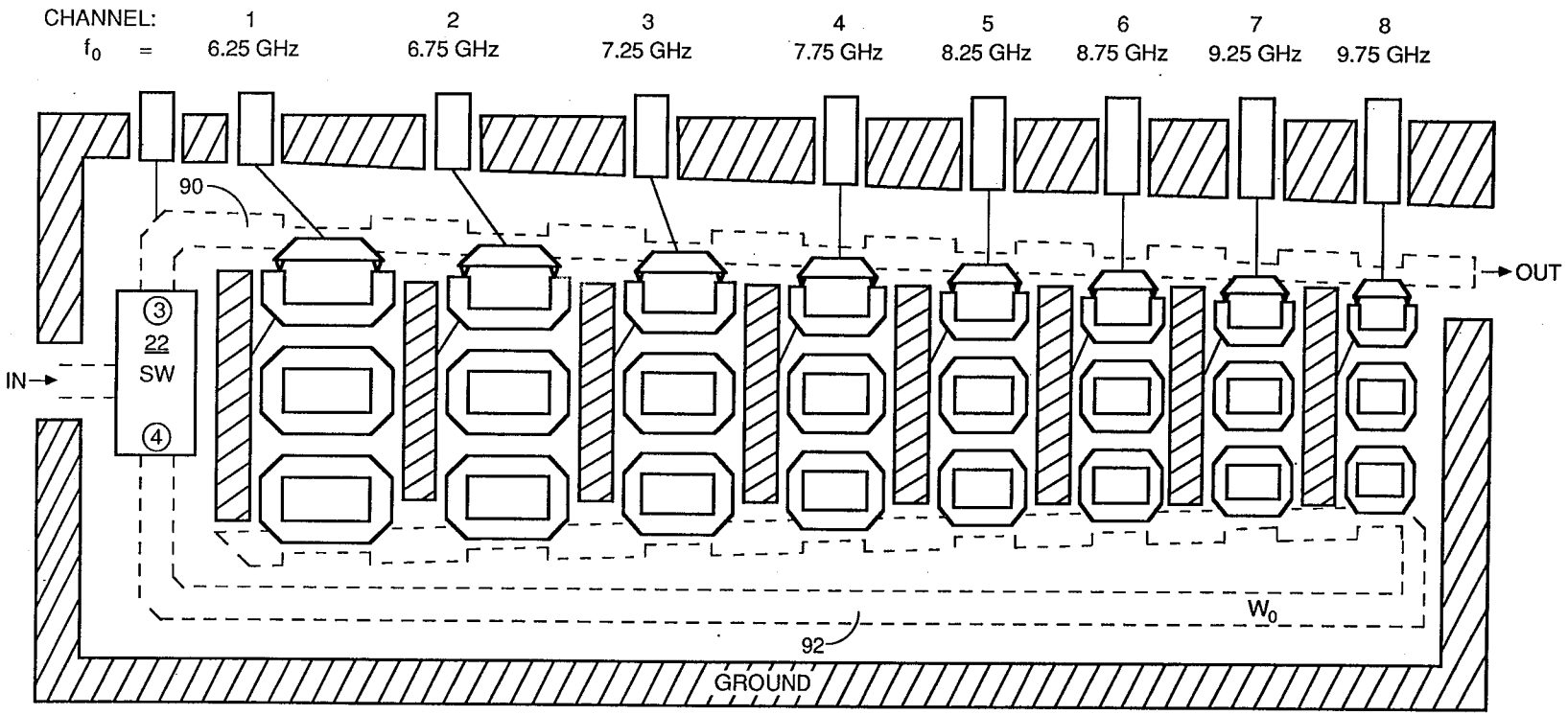

FIG. 8 depicts an eight channel, 6 to 10 GHz switchable filter bank.

Figure 9:
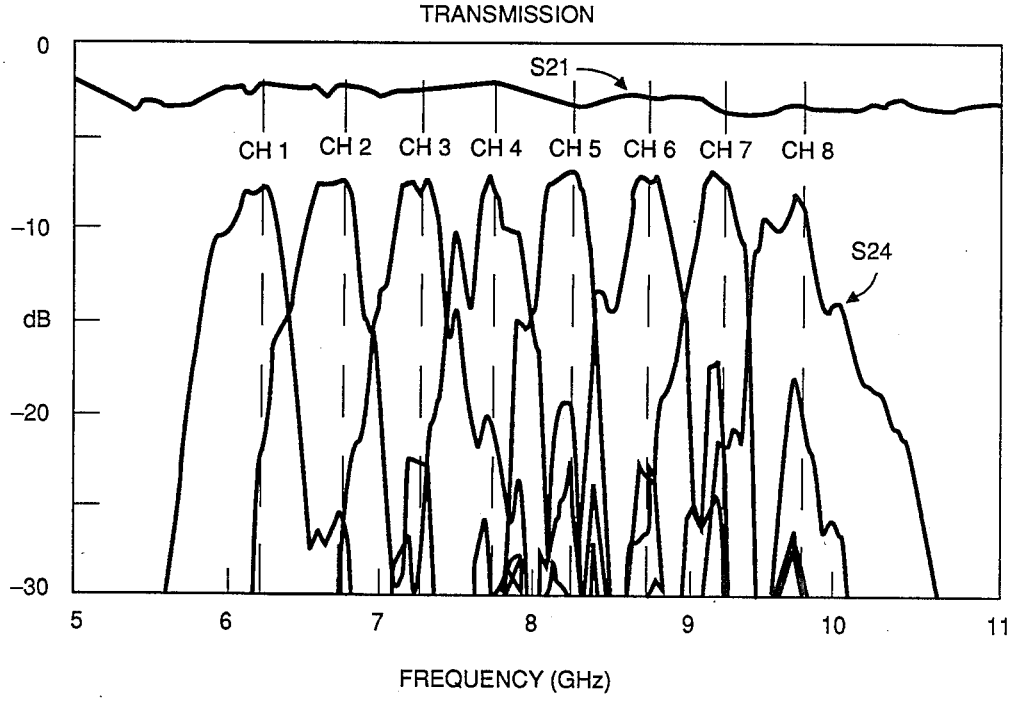
Figure 10:
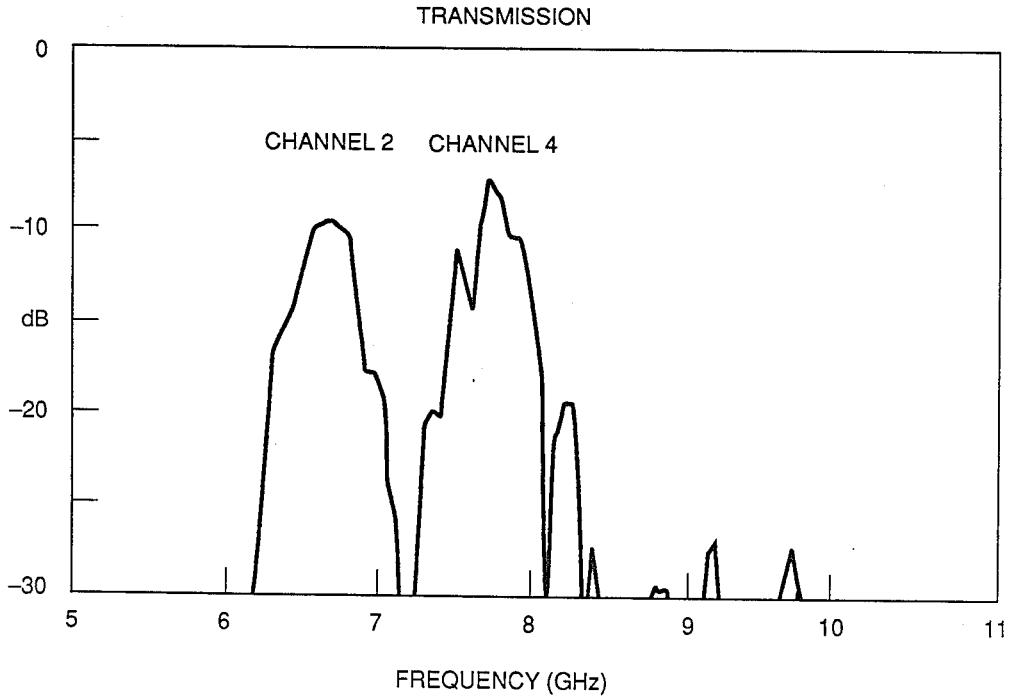

FIG. 9 depicts the individual channel transmission responses of the filter bank in FIG. 8, and FIG. 10 depicts the transmission response with channels 2 and 4 on.

DESCRIPTION OF THE PREFERRED EMBODIMENT

Figure 1:
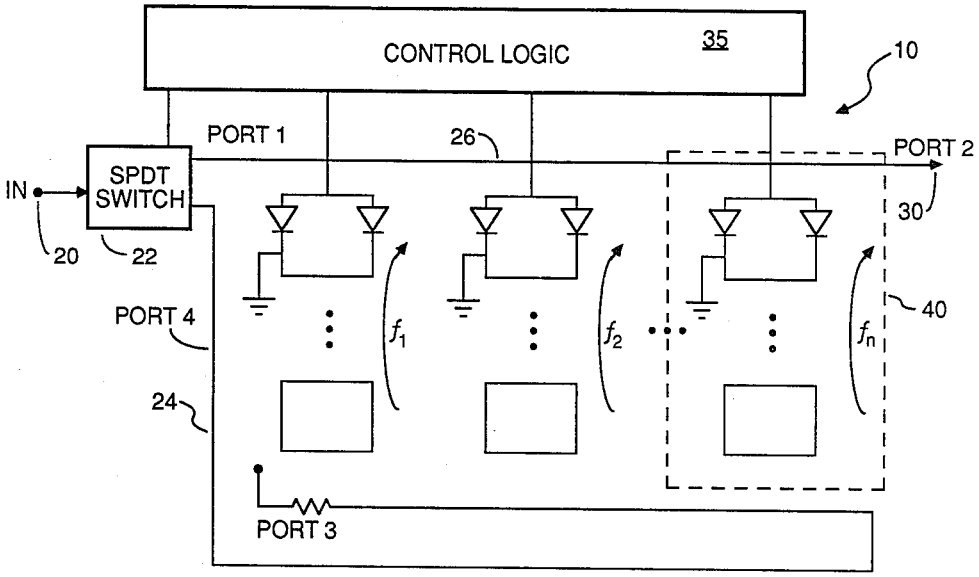
FIG. 1 is a block diagram of a diode switched filter bank incorporating the present invention.

Referring to FIG. 1, there is shown a circuit schematic of a diode switched filter bank which can be used to transmit selectively a broadband signal or any discrete or combination of narrow band signals centered at frequencies fl to fn while maintaining a low input VSWR (voltage standing wave ratio).

In the preferred embodiment, the filter bank 10 comprises an input port 20 which is controllably coupled by a single pole double throw switch 22 to either of two transmission lines 24 and 26. The output port 30 of the device is at the end of transmission line 26. When the switch 22 is set to couple the input port 20 to line 26, the device 10 is an allpass circuit.

When switch 22 is set to couple the input port 20 to line 24, the device 10 is a multiple band filter. Only the frequency bands passed by the directional filters 40 will be passed to the output port 30. The directional filters 40 used in the preferred embodiment are stipline directional filters, each directional filter 40*a* having three resonators 44*a*–44*c*.

As known to those skilled in the art of microwave filter design, the number of resonators used in a directional filter is determined by the desired attenuation skirt on the corresponding frequency band. In other words, by using more resonators, once can increase the sharpness of the shape of the frequency band to be passed by the filter 10.

As will be explained in more detail below, a set of control signals from Control Logic 35 (typically a computer with an interface for generating separate control signals for each channel and for the switch 22) determines which channels of the device 10 will be on, and thus determines the frequencies which will be passed to the output 30.

Note that switch 22 is a nonreflective microwave single pole double throw switch, such as the model 2106-XK made by SDI.

The performance of the circuit in FIG. 1 is based on the fact that each directional filter (i.e., resonator) can be turned into an allpass circuit simply by disconnecting part of the filter. In particular, each directional filter 40 works by channeling or directing the energy in a particular frequency band (i.e., the signals in that frequency band) from one transmission line to another. When a directional filter is disconnected, it does not affect the signals in the transmission lines, and the filter acts as an allpass circuit.

Figure 2A:
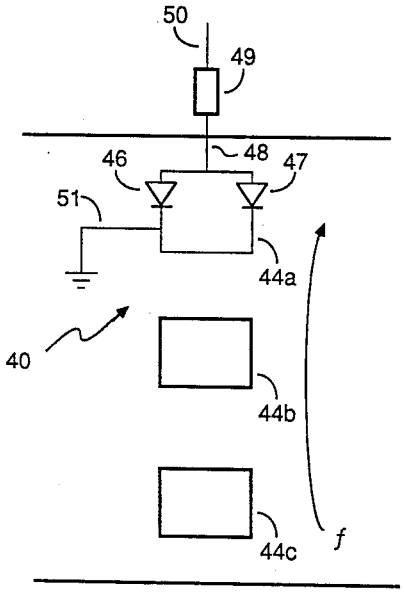

Referring to FIG. 2*a*, there is shown one directional filter 40 with three resonators 44, one of which has a series diode 46 and 47 on each side of the top strip of the resonator 44. When the diodes 46 and 47 are forward biased, the filter 40 acts as a directional filter; when the diodes are unbiased or reverse biased (creating a depleted PN junction between the cathode and anode of the diodes), the top strip of resonator 44*a* is disconnected from its bottom portion—and the filter 40 then acts as an allpass circuit.

Diodes 46 and 47 are PIN switching diodes—Model number Alpha DSM4380A was used in the prototypes of the preferred embodiment. The anodes of the diodes 46 and 47 are connected to a control line 48–50. The first part of the control line is a high impedance connector 48, having a length of approximately one quarter-wave at the center frequency of this filter, with a typical impedance of 150 ohms. The second part of the control line is a strip line capacitor 49 with a sufficiently large capacitance to filter out all RF noise on the control line. The last part 50 of the control line is an ordinary connector the control logic 35.

The cathodes of the diodes are d.c. coupled to ground by a high impedance (typically 150 ohm) quarter-wave length connector 51.

Figure 2B:
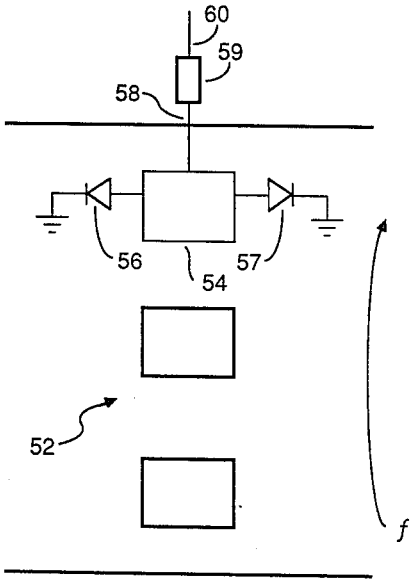

FIG. 2*b* shows an alternate circuit arrangement for turning a directional filter 52 into an allpass circuit. In this arrangement, one resonator 54 has shunt diodes 56 and 57 on either side of the resonator 54. The cathodes of the shunt diodes are coupled directly to ground, and the anodes of the diodes are d.c. coupled to a control line 60 by a quarter-wave length high impedance connector 58 and a strip line capacitor 59 for filtering out RF noise on the control line 60. In this arrangement, when the diodes 56 and 57 are forward biased, the ends of the top strip of resonator 54 are grounded and the filter 52 acts as an allpass circuit. When the diodes 56 and 57 are unbiased or reverse biased, the resonator 54 is not grounded and the filter 52 acts as a directional filter.

Thus, in the arrangement shown in FIG. 1, the control logic 35 determines which directional filters are enabled by sending one control signal to each directional filter 40.

Referring to FIG. 3, there is shown a schematic representation of a single three resonator directional filter 40, along with a listing of relevant design parameters for calculating even mode and odd mode impedances from which physical dimensions are derived. Using well known directional filter design techniques (e.g., see Design of Microwave Filters, Impedance Matching Networks, and Coupling Structures, published by SRI in 1963) the design parameters shown in FIG. 3 can be used to derive the physical measurements (see FIG. 4*a*) of the resonators, $W_{01}$ and $W_{12}$, the spacing of the resonators from one another, $S_{12}$, and the overlap of the top and bottom resonators with the transmission lines, $S^{01}$.

For a single directional filter, the coupled section between Port 1 and Port 2 (in FIG. 3) is an allpass network (when the directional filter is disabled) which is equivalent to a transmission line with a characteristic impedance equal to (Zoe+Zoo)/2. The value of this impedance can be made to closely match the standard 50 ohm impedance used in most microwave circuits.

Figure 4A:
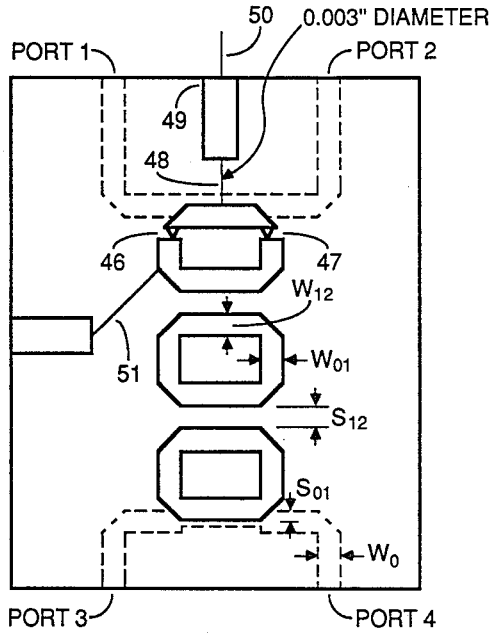

FIG. 4*a* depicts a single switchable resonator used to test the concept of the present invention. The circuit was made by printing the filter on both sides of 0.010 inch thick substrate having a dielectric constant of 2.32 (Duroid 5870). The PIN switching diodes 46 and 47 were installed on the substrate with silver epoxy. The dashed lines in FIG. 4*a* represent striplines on the back surface of the substrate, and solid lines represent striplines on the front surface.

Figure 4B:
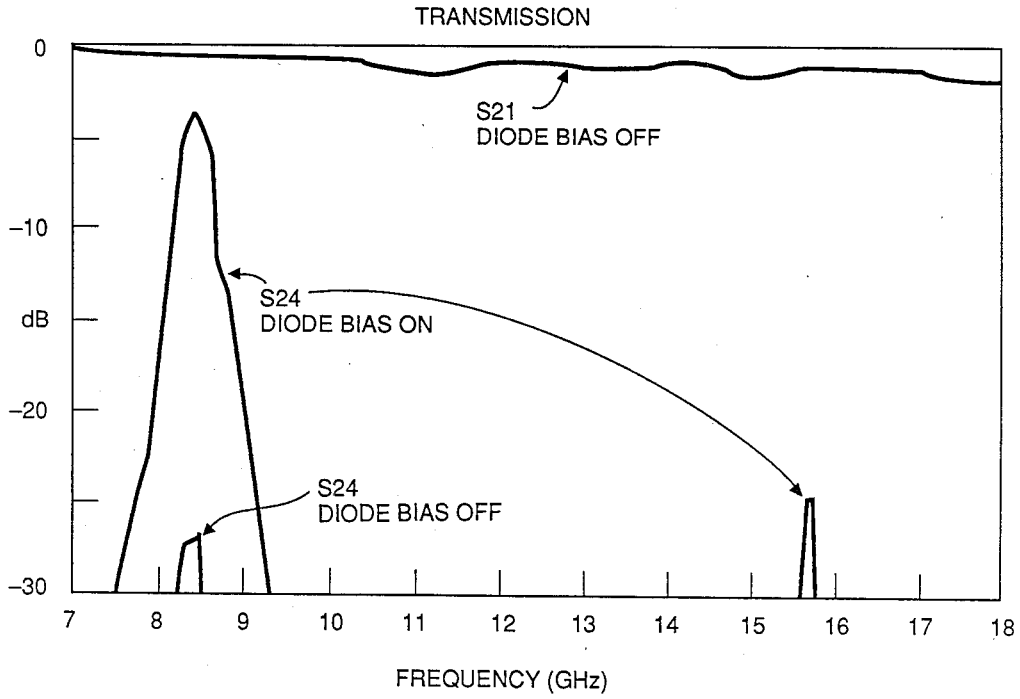

FIG. 4*b* shows measurements of the transmission response of this filter in selected channel mode, S24: from port 4 to port 2 with the PIN diodes forward biased (on) and unbiased (off), and in allpass mode, S21: from port 1 to port 2 with the PIN diodes unbiased (off).

FIG. 5 dipicts one prototype of the preferred embodiment. It was made using stripline with groundplane spacing of 0.125 inches. The circuit was made by printing the filter on both sides of a 0.010 inch thick substrate having a dielectric constant of 2.32 (Duroid 5870). The PIN switching diodes 46 and 47 were installed on the substrate with silver epoxy. Dashed striplines represent in FIG. 4*a* represent stiplines on the back surface of the substrate, and solid lines represent striplines on the front surface.

Table 1 shows the dimensions of the filter shown in FIG. 5.

TABLE 1

DESIGN PARAMETERS FOR FILTER IN FIG. 5

| $f_0$ | $\omega$ | $Q_e$ | $C_{01}$ | $C_{12}$ | $(Z_{oe})_{01}$ | $(Z_{oe})_{12}$ | $S_{01}$ | $S_{12}$ | $W_{01}$ | $W_{12}$ | $(S/b)_{01}$ | $(S/b)_{12}$ | $(W/b)_{01}$ | $(W/b)_{12}$ |
|---|---|---|---|---|---|---|---|---|---|---|---|---|---|---|
| 8.25 | .0424 | 24.33 | .478 | .122 | 84.2 | 56.2 | .013 | .034 | .067 | .093 | .10 | .275 | .536 | .746 |
| 8.75 | .040 | 25.78 | .466 | .1156 | 82.8 | 55.8 | .011 | .036 | .068 | .093 | .09 | .300 | .544 | .748 |
| 9.25 | .0378 | 27.29 | .454 | .109 | 81.7 | 55.5 | .010 | .038 | .069 | .094 | .08 | .310 | .522 | .750 |
| 9.75 | .0359 | 28.73 | .444 | .1036 | 80.6 | 55.2 | .009 | .040 | .070 | .094 | .07 | .325 | .560 | .751 |

Other Parameters:
$f_2 - f_1 = 0.35$ GHz
$\omega = (f_2 - f_1)/fo$
$g_1 = 1.0315$
$g_2 = 1.1474$
$W_0 = 0.096$ inches
Key:
$f_0$: center of channel, GHz
$S_{01}$: overlap of resonator and transmission line
$S_{12}$: gap between resonators
$W_0$ = width of 50 ohm line
$W_{01}$, $W_{12}$: width of resonator striplines
b = 0.125 inches (ground plane spacing)
t = 0.010 inches (stipline thickness)
$\epsilon_r = 2.32$ (dielectric constant)

Ground lines in FIG. 5 are cross hatched, and are coupled to zero volt voltage potential via connections (not shown) on the back surface of the substrate.

The 8–18 GHz bandpass filter 80, the 10 GHz lowpass filter 82, and the 8–10 GHz bandstop filter 84 are conventional stripline designs. Because of the tight coupling required between the transmission lines (90 and 92) and the resonators, an over-under type of construction was used. The parameter $S_{01}$ denotes the overlap of the resonators and the transmission lines for each directional filter.

When the filter device 10 is to be used in allpass mode, the switch 22 is set to couple the input port to transmission line 90. Furthermore, all of the PIN diodes for the resonators must be unbiased (or reverse biased). If the PIN diodes for any one of the resonators is forward biased (i.e., turned on), the corresponding frequency band will be transmitted to Port 3, and will be removed from the signal passing down transmission line 90.

In this example, the input signal is filtered by bandpass filter 80 so that only frequencies between 8 and 18 GHz are passed.

If bandstop filter 84 is turned on (by forward biasing its control diode)—then it partially suppress the 8–10 GHz portion of the signal on line 90.

capacitance and lower series resistance become available, high frequency loss holes will become less of a problem (or will be problematic only at higher frequencies).

FIG. 7 shows the transmission response of the filter in FIG. 5, showing the response for each channel with the other three channels off. The response shape of each narrowband channel was affected adversely in this prototype by VSWR (voltage standing wave ratio) interaction between the switch 22 and the filter circuit, creating many ripples as a consequence on the long interconnecting transmission line 92. As will be understood by those skilled in the art, these VSWR interactions would be eliminated by installing an isolator (e.g., a ferrite isolator) between the switch 22 and the filter circuit.

FIG. 8 depicts a second filter prototype of the present invention. This filter is an eight channel, 6 to 10 GHz switchable filter bank, built using the dimensions listed in Table 2.

TABLE 2

DESIGN PARAMETERS FOR FILTER IN FIG. 8

| $f_0$ | $\omega$ | $Q_e$ | $C_{01}$ | $C_{12}$ | $(Z_{oe})_{01}$ | $(Z_{oe})_{12}$ | $S_{01}$ | $S_{12}$ | $W_{01}$ | $W_{12}$ | $(S/b)_{01}$ | $(S/b)_{12}$ | $(W/b)_{01}$ | $(W/b)_{12}$ |
|---|---|---|---|---|---|---|---|---|---|---|---|---|---|---|
| 6.25 | .056 | 18.42 | .539 | .161 | 91.5 | 58.2 | .018 | .025 | .063 | .092 | .14 | .20 | .504 | .736 |
| 6.75 | .051 | 19.90 | .522 | .149 | 89.3 | 57.6 | .016 | .027 | .064 | .092 | .13 | .22 | .512 | .736 |
| 7.25 | .048 | 21.37 | .506 | .139 | 87.3 | 57.0 | .015 | .030 | .065 | .093 | .12 | .245 | .520 | .744 |
| 7.75 | .045 | 22.84 | .491 | .130 | 85.7 | 56.6 | .004 | .032 | .066 | .093 | .11 | .26 | .528 | .744 |
| 8.25 | .0424 | 24.33 | .478 | .122 | 84.2 | 56.2 | .013 | .034 | .067 | .093 | .10 | .275 | .536 | .746 |
| 8.75 | .040 | 25.78 | .466 | .1156 | 82.8 | 55.8 | .011 | .036 | .068 | .093 | .09 | .300 | .544 | .748 |
| 9.25 | .0378 | 27.29 | .454 | .109 | 81.7 | 55.5 | .010 | .038 | .069 | .094 | .08 | .310 | .522 | .750 |
| 9.75 | .0359 | 28.73 | .444 | .1036 | 80.6 | 55.2 | .009 | .040 | .070 | .094 | .07 | .325 | .560 | .751 |

Other Parameters:
$f_2 - f_1 = 0.35$ GHz
$\omega = (f_2 - f_1)/fo$
$g_1 = 1.0315$
$g_2 = 1.1474$
$W_0 = 0.096$ inches
Key:
$f_0$: center of channel, GHz
$S_{01}$: overlap of resonator and transmission line
$S_{12}$: gap between resonators
$W_0$ = width of 50 ohm line
$W_{01}$, $W_{12}$: width of resonator striplines
b = 0.125 inches (ground plane spacing)
t = 0.010 inches (stipline thickness)
$\epsilon_r = 2.32$ (dielectric constant)

As is frequently the case with such filters, a number of tuning screws were used to minimize reflections caused by discontinuities in the resonators, although the screws lowered the Q of the resonators.

When the filter device 10 is to be used in selected channel mode, the switch 22 is set to couple the input port to transmission line 92. Furthermore, the PIN diodes for each of the channels to be selectively transmitted to Port 2 must be biased so that the corresponding resonators are enabled. When the PIN diodes for any one of the resonators is turned on, the corresponding frequency band will be transmitted from transmission line 92 to transmission line 90 (i.e., to Port 2), and will be removed from the signal passing down transmission line 92 toward Port 3.

FIG. 6 shows the transmission frequency response of the filter in FIG. 5, in broadband mode (i.e., with the switch 22 coupling the input port 20 to transmission line 90, and with all diodes biased off), and in broadband mode with the bandstop filter 84 turned on.

The loss holes located above 16 GHz are caused by the parasitic capacitances of the diodes. Using diodes with lower capacitance (e.g., less than 0.03 pf) would improve the high frequency response. However, lower capacitance diodes generally have higher series resistance which would increase the loss over the entire frequency band. As improved PIN diodes with lower FIG. 9 depicts the individual channel transmission responses of the second prototype. FIG. 10 depicts the transmission response of the second prototype with channels 2 and 4 on. The responses for other combinations of the eight channels were generally approximately equal to the sum of the separate responses of the corresponding channels.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

For instance, other embodiments of the invention may use more or less channels and the particular design of the directional filters in the channels will vary from application to application. Other aspects of such filters which depend on the particular application are the use of bandpass and/or lowpass filters on the transmission lines of the device (such as those used in FIG. 5), the amount of overlap or separation of the frequencies passed by each channel, and the control logic used to control the selection of channels.

What is claimed is:

1. A microwave filter, comprising:

a first transmission line and a second transmission line, and an output port at one end of said first transmission line;

switch means, coupled to said first and second transmission lines, responsive to all pass and band pass mode selection signals for selectively transmitting an input signal to one of said first and second said transmission lines, respectively;

a plurality of directional filters, each directional filter having means for transmitting signals in a corresponding frequency band from one of said transmission lines to the other of said transmission lines; each of said directional filters including a separate diode means for enabling and disabling the operation of each said directional filter in accordance with a bias voltage applied to said separate diode means; and control means coupled to said switch means and said directional filters for selecting a mode of operation for said microwave filter, including all pass mode selection means for generating an all pass mode selection signal and applying a bias voltage to each said diode means for disabling the operation of said directional filters, and band pass mode selection means for generating a band pass mode selection signal and applying bias voltages to said separate diode means to enable and disable selected ones of said directional filters;

whereby, said microwave filter can selectively transmit a broadband signal or any discrete or combination of the frequency bands transmitted by said directional filters.

2. A microwave filter as set forth in claim 1, each of said directional filters comprising a plurality of resonators placed between said first and second transmission lines, said plurality of resonators including a resonator having diode means for enabling and disabling the operation of said resonator.

3. A method of filtering a microwave signal, comprising the steps of:

providing first and second transmission lines, each have first and second ends, the second end of said first transmission line comprising the port for receiving the filtered microwave signal;

providing a plurality of narrowband directional filters placed between said first and second transmission lines, each directional filter having means for transmitting signals in a corresponding frequency band from one of said transmission lines to the other of said transmission lines;

selectively transmitting, in response to all pass and band pass mode selection signals, an input microwave signal to the first end of said first and second transmission lines, respectively; and selecting a mode of operation selected from the set consisting of all pass mode and band pass mode, including the steps of generating an all pass mode selection signal when selecting all pass mode, generating a band pass mode signal when selecting band pass mode, disabling the operation of all of said narrowband directional filters when selecting all pass mode, and enabling selected ones of said narrowband directional filters when selecting band pass mode so that selected frequency bands of said input signal are transmitted to said port for receiving the filtered microwave signal.

4. A method of filtering a microwave signal as in claim 3, said step of providing a plurality of narrowband directional filters providing direction filters comprising a plurality of resonators placed between said first and second transmission lines, said plurality of resonators including a resonator having diode means for enabling said disabling the operation of said resonator.

* * * * *